US008662622B2

(12) United States Patent
Simpson et al.

(10) Patent No.: US 8,662,622 B2
(45) Date of Patent: Mar. 4, 2014

(54) PRINT CARTRIDGE OUTPUT SAMPLE

(75) Inventors: Shell S. Simpson, Boise, ID (US); Stephen L. Testardi, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 286 days.

(21) Appl. No.: 13/119,179

(22) PCT Filed: Sep. 16, 2008

(86) PCT No.: PCT/US2008/076569

§ 371 (c)(1),
(2), (4) Date: Mar. 15, 2011

(87) PCT Pub. No.: WO2010/033110

PCT Pub. Date: Mar. 25, 2010

(65) Prior Publication Data

US 2011/0170146 A1 Jul. 14, 2011

(51) Int. Cl.
*B41J 29/393* (2006.01)

(52) U.S. Cl.
USPC ..... 347/19

(58) Field of Classification Search
USPC ..... 347/19; 283/74
See application file for complete search history.

(56) References Cited

U.S. PATENT DOCUMENTS

| | | | | |
|---|---|---|---|---|
| 6,862,652 | B1 | 3/2005 | Tsuji | |
| 6,995,858 | B2 | 2/2006 | Murakami et al. | |
| 2005/0040234 | A1 * | 2/2005 | Euchner et al. | 235/454 |

FOREIGN PATENT DOCUMENTS

| | | | |
|---|---|---|---|
| JP | 2004-54244 | A | 2/2004 |
| KR | 10-2000-0035642 | A | 6/2000 |
| KR | 10-2003-0088064 | A | 11/2003 |
| WO | 00/26034 | A2 | 5/2000 |
| WO | 01/25016 | A1 | 4/2001 |
| WO | 03/100529 | A1 | 4/2003 |

OTHER PUBLICATIONS

International Search Report (ISR) for counterpart application PCT/US2008/076569, Korean Intellectual Property Office, May 28, 2009, pp. 1-14.

* cited by examiner

*Primary Examiner* — Julian Huffman

(57) ABSTRACT

A system and method print an output sample including print cartridge characteristic information.

17 Claims, 6 Drawing Sheets

PRINT CARTRIDGE OUTPUT SAMPLE

BACKGROUND

Faulty print cartridges may produce faulty output. Such faulty print cartridges are frequently returned to the print cartridge manufacturer. Unfortunately, empty print cartridges are sometimes slightly refurbished and improperly claimed as being faulty while being returned for replacement.

DETAILED DESCRIPTION OF THE EXAMPLE EMBODIMENTS

Figure 1:
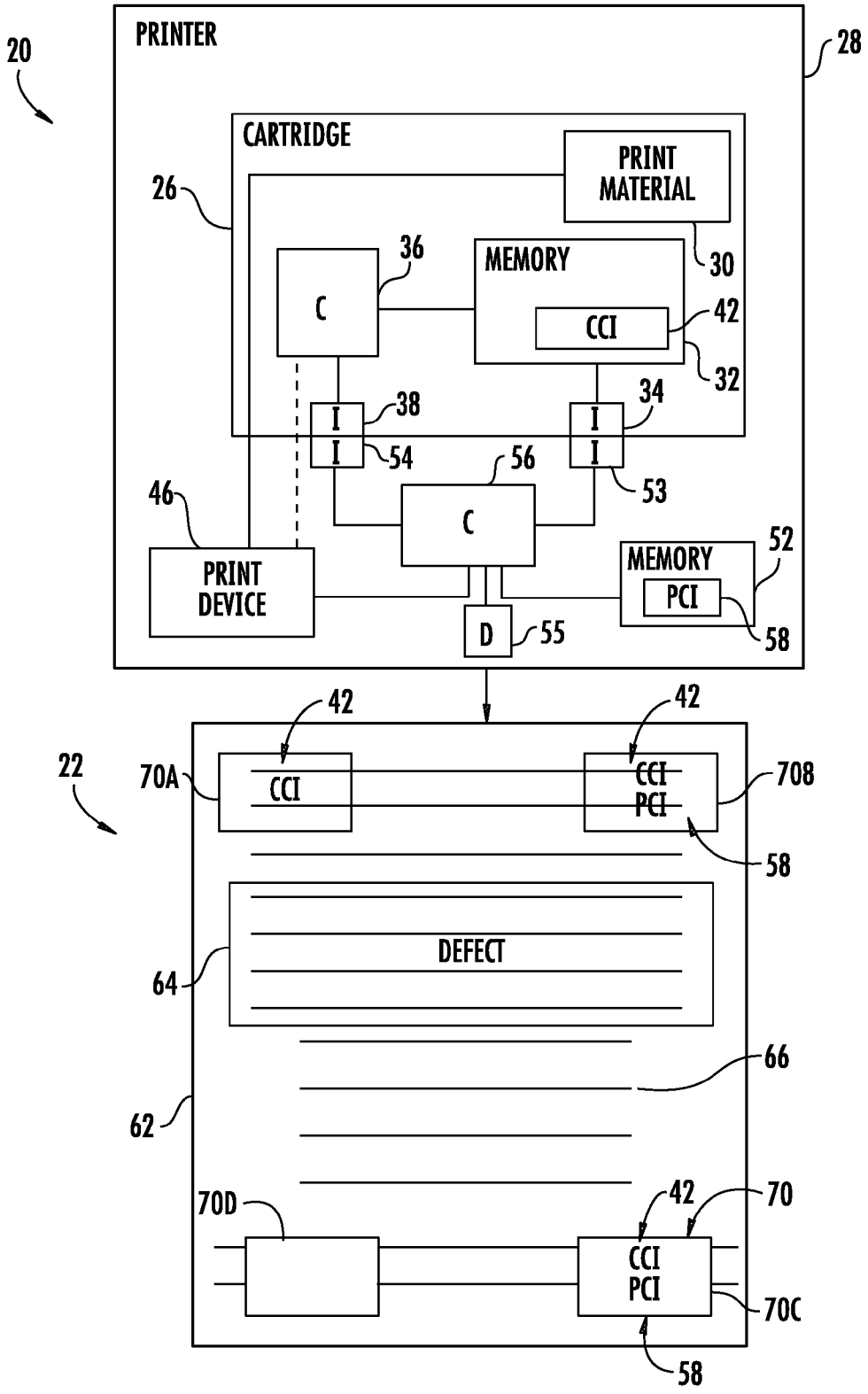
FIG. 1 is a schematically illustration of a printing system and an output sample according to an example embodiment.

FIG. 1 schematically illustrates printing system 20 and an output sample 22 printed by printing system 20. As will be described hereafter, printing system 20 allows verification that a print cartridge being returned is the same print cartridge that printed an output sample evidencing a defect in the print cartridge. As a result, fraudulent returns of print cartridges may be reduced.

Printing system 20 includes print cartridge 26 and printer 28. Print cartridge 26 supplies print material to printer 28. Print cartridge 26 includes print material 30, memory 32, memory interface 34, controller 36 and controller interface 38. Print material 30 comprises one or more materials that are to be patterned, deposited or applied to a substrate, such as a web or sheet, by printer 28. Print material 30 is contained within an internal volume within cartridge 26. Examples of print material 30, include, but are not limited to, dry toner, liquid toner, fluid ink and other marking fluids or other fluids for forming images or three-dimensional structures upon a substrate using printer 28.

Memory 32 comprises one or more computer-readable or processor-readable structures on which information or data may be stored and subsequently read or retrieved. Memory 32 is affixed to or carried by cartridge 26 so as to remain with cartridge 26 prior to insertion of our connection of cartridge 26 to printer 28 and after removal of cartridge 26 from printer 28. Examples of memory 32 include but are not limited to, a random access memory (RAM), a read only memory (ROM), hardwire circuitry, software, a mass storage device, or some other persistent storage. Memory 32 stores cartridge characteristic information (CCI) 42 (schematically shown).

Cartridge characteristic information 42 comprises information or data specifically associated with an individual cartridge 26 or a family or group of cartridges 26 having one or more common attributes. Cartridge character information 42 distinguishes a particular cartridge 26 from other cartridges.

As a result, cartridge character information 42 assists in identifying the actual cartridge 26 which was use to print output sample 22.

In one embodiment, cartridge character information 42 includes identification indicia assigned to the particular cartridge 26, which distinguishes cartridge 26 from other cartridges. For example, cartridge character information 42 may include model information for cartridge 26, may include a manufacture date of cartridge 26, may include a serial number for cartridge 26, may include an authentication state of cartridge 26, may include a lot number or identification of a specific group of cartridges 26 or may include a digital signature. Such cartridge character information 42 constituting identification indicia may be assigned to cartridge 26 by the manufacturer of cartridge 26, by a retailer selling cartridge 26, when cartridge 26 is first installed in or connected to printer 28.

In one embodiment, cartridge character information 42 includes particular status information for cartridge 26, which distinguishes cartridge 26 from other cartridges at a particular moment in time, which would also serve to distinguish cartridge 26 from other even identical cartridges 26, which may have different statuses. For example, cartridge character information 42 may include the used or remaining life of cartridge 26, the number of pages, sheets or surface area printed with cartridge 26, the amount of printing material remaining in cartridge 26 or the like. Such information may be written to cartridge 26 by printer 28 during use of cartridge 26.

In one embodiment, memory 32 may be configured to store a history of such cartridge character information over time to provide a log of cartridge information. In other words, memory 32 may include a plurality of status entries over time with or without corresponding dates at which such entries were made. For example, memory 32 may store a number of pages printed by cartridge 26, the remaining useful life of 26, the present life remaining of cartridge 26 etc. along with an associated date corresponding to the particular status information. By way of a more specific example, memory 32 may store information indicating that cartridge 26 had 5% of printing material remaining on January 1. The history log contained in memory 32 may additionally include information indicating that cartridge 26 had 3% of printing material remaining on January 10. As will be described hereafter, this information would allow improperly returned refurbished cartridges to be identified.

In addition to cartridge characteristic information 42, memory 32 may also contain operating instructions for controller 36 or for a controller associated with printer 28. Such instructions may direct controller 36 of cartridge 26 or a controller of printer 28 to include such cartridge characteristic information 42 when printing an output sample such as output sample 22. Such instructions contained in memory 32 may also include instructions for encoding such cartridge character information when it is printed as part of an output sample 22 or otherwise printing the cartridge characteristic information 42 in such a fashion so as to inhibit the party attempting fraud from viewing or understanding be printed printer characteristic information 58 to inhibit the party committing fraud from realizing that the printed output sample 22 reveals such fraud. For example, in addition to or as an alternative to encoding the cartridge characteristic information 42, such instructions may direct printer 28 to print such information with a particular type of ink that is not readily viewable to the naked eye. In yet other embodiments, memory 32 may omit such instructions and merely include cartridge character information 42.

Memory interface 34 comprises a mechanism by which memory 32 may be directly accessed in read by printer 28 without going through controller 36. In one embodiment, memory 34 may comprise one or more electrical contact pads, electrical prongs or electrical sockets. In other embodiments, memory interface 34 may be omitted.

Controller 36 comprises one or more processing units coupled to and carried by cartridge 26. Controller 36 is in communication with a 46 associated with either a cartridge 26 or printer 28. Controller 36 receives and stores cartridge status information (constituting cartridge characteristic information 42) onto memory 32. Controller 36 may also be configured to retrieve cartridge characteristic information 42 from memory 32 and to relay such information to printer 28 for printing output sample 22 including cartridge character information 42. In one embodiment, controller 36, following instructions contained in memory 32, may also control and direct printing of output sample 22 by printer 28. In some embodiments which include interface 34, controller 36 and interface 38 may be omitted.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 36 may be embodied as part of one or more application-specific integrated circuits (ASICs). Unless otherwise specifically noted, the controller is not limited to any specific combination of hardware circuitry and software, nor to any particular source for the instructions executed by the processing unit.

Interface 38 comprises a mechanism by which controller 36 may communicate with printer 28. In particular, interface 38 facilitates communication with controller 36 in a wired or wireless fashion. In one embodiment, interface 38 may comprise one or more electrical contact pads, electrical prongs or electrical sockets. In other embodiments, interface 38 may be omitted.

Printer 28 uses print material 30 to print images, patterns or the like of print material 30 on one or more substrates. Printer 28 further uses print material 30 from print cartridge 26 to print an output sample 22 illustrating any defects resulting from a faulty print cartridge 26. Printer 28 includes memory 52, memory interface 53, controller interface 54, display 55 and controller 56. Memory 52 comprises one or more computer-readable or processor-readable structures on which information or data may be stored and subsequently read or retrieved. Examples of memory 52 include but are not limited to, a random access memory (RAM), a read only memory (ROM), hardwire circuitry, software, a mass storage device, or some other persistent storage. Memory 52 stores printer characteristic information (PCI) 58 (schematically shown).

Printer character information 42 comprises information or data specifically associated with an individual printer 28 or a family or group of printers 28 having one or more common attributes. Printer character information 58 distinguishes a particular printer 28 from other printers. As a result, printer character information 58 assists in identifying the actual printer 28 which was use to print output sample 22.

In one embodiment, printer characteristic information 58 includes identification indicia assigned to the particular printer 28, which distinguishes printer 28 from other printers. For example, printer characteristic information 58 may include model information for printer 28, printer characteristic information 58 may include a manufacture date of printer 28, may include a serial number for printer 58, may include a digital signature of printer 28. Such printer characteristic information 58 constituting identification indicia may be assigned to printer 28 by the manufacturer of printer 28, by a retailer selling printer 28 or when printer 28 or driver software for printer 28 is first installed in a computer or when printer 28 is first set up by an end user. As will be described hereafter, printer characteristic information 58 may be used to verify that a particular output sample, such as output sample 22, has been printed using a correct printer designed for use with the particular cartridge attempted to be returned.

In one embodiment, printer characteristic information 58 includes particular status information for printer 28. For example, printer characteristic information 58 may include information regarding printing errors or printing defects caused by malfunctioning a printer 28 itself rather than a defect associated with print cartridge 26. Such information may be written to memory 52 by printer 28 during use of printer 28.

In one embodiment, memory 52 may be configured to store a history of such printer malfunction events over time to provide a log of printer information. In other words, memory 52 may include a plurality of status entries over time with or without corresponding dates at which such entries were made. As a result, such information may allow the determination of whether a defect on output sample 22 can be attributed to an error associate with cartridge 26 or alternatively an error or malfunctioning of printer 28 itself. As will be described hereafter, this information would allow improperly returned refurbished cartridges to be identified.

In addition to printer characteristic information 58, memory 52 may also contain operating instructions for controller 56. Such instructions may direct controller 56 of printer 28 to include such cartridge character information 42 when printing an output sample such as output sample 22. Such instructions contained in memory 52 may also include instructions for encoding such cartridge character information when it is printed as part of an output sample 22 to inhibit the party committing fraud from realizing that the printed output sample 22 reveals such fraud. In one embodiment, memory 52 may contain instructions directing a printer 28 to print output sample 22 additionally including printer characteristic information 58. In one embodiment, such printer characteristic information 58 may also be encoded or otherwise printed in such a fashion for us to inhibit the party attempting fraud from viewing or understanding be printed printer characteristic information 58.

Memory interface 53 comprises a mechanism by which controller 56 may directly access memory 52 of cartridge 26 without going through controller 36. In one embodiment, interface 53 may comprise one or more electrical contact pads, electrical prongs or electrical sockets. In other embodiments, interface 53 may be omitted.

Interface 54 comprises a mechanism by which controller 56 may communicate with controller 36 of cartridge 26. In particular, interface 54 facilitates communication with controller 36 in a wired or wireless fashion. In one embodiment, interface 54 may comprise one or more electrical contact pads, electrical prongs or electrical sockets. In other embodiments, interface 54 may be omitted.

Print device 46 comprises a mechanism to figure to selectively pattern or deposit printing material 30 onto a print medium, a printed substrate, a web, a sheet or the light. Print device 46 operates in response to control signals of received from one or both of controller 36 of print cartridge 26 and/or controller 56 of printer 28. In one embodiment, print device 46 is incorporated as part of printer 28 and remains with printer 28 upon removal of cartridge 26 from printer 28. In another embodiment, print device 46 may be incorporated as part of print cartridge 26 so as to accompany print cartridge 26 upon removal of print cartridge 26 from printer 28. In one embodiment, print device 46 comprises an electrostatic imaging system using dry or liquid toner print material supplied by cartridge 26. In another embodiment, print device 46 may comprise a thermoresistive or piezo resistive drop-on-demand ink jet print head or print heads.

Display 55 comprises a screen, array of lights or LEDs or other mechanisms compared to communicate information or data to a person using printer 28. In one embodiment, display 55 is provided or incorporated as part of printer 28. In another embodiment, display 55 may be provided or incorporated as part of an external computer system or an external electronic device connected to printer 28 in a wired fashion or wirelessly. Display 55 presents information regarding printer 28 and print jobs being performed by printer 28. Display 55 may further present options or prompts requesting instructions, commands are selections from a person using printer 28.

Controller 56 comprises one or more processing units incorporated as part of printer 28. Controller 56 is in communication with print device 46 associated with either cartridge 26 or printer 28. In one embodiment, controller 56 receives and stores cartridge status information (constituting cartridge characteristic information 42) onto memory 32 or memory 52 of printer 28. In one embodiment, controller 56 receives and stores printer status information (constituting printer characteristic information 58) in memory 52 or memory 32 of cartridge 26. Controller 56 may also be configured to directly retrieve cartridge characteristic information 42 from memory 32 or to retrieve such cartridge characteristic information 42 from memory 32 through controller 36 for printing output sample 22.

As shown by FIG. 1, output sample 22, printed by printer 28 using print material 30 from print cartridge 26, includes the printed upon substrate or medium 62 including a printing defect 64 (schematically represented). Along with defect 64, output sample 22 may additionally include other printed portions 66 which are not defective. The printing defect 64 may evidence the defective nature of print cartridge 26.

As further shown by FIG. 1, output sample 22 additionally includes one or more printed validation stamps 70. FIG. 1 illustrates four different examples, validation stamps 70A, 70B, 70C and 70D, at four different locations on medium 62. Validation stamp 70A comprises a printed area including cartridge characteristic information printed upon medium 62. Such cartridge characteristic information 42 is read from memory 32. With validation stamp 70A, the cartridge characteristic information overlies printed portions 66 of output sample 22. Validation stamp 70B is similar to validation stamp 70A except that validation stamp 70B is at a different location and additionally includes printer characteristic information 58. Printer characteristic information 58 is read from memory 52. Validation stamp 70C is similar to validation stamp 70B except that validation stamp 70C replaces the underlying printed portions 66 such that the underlying printed portions 66 can no longer be seen beneath validation stamp 70C. Validation stamp 70D is similar to validation stamp 70C except that both the cartridge characteristic information 42 and the printer characteristic information 58 are encrypted or invisible or indiscernable to a naked eye as schematically represented by the x-outs. Although validation stamps 70B, 70C and 70D are illustrated as each including both cartridge characteristic information 42 and printer characteristic information 58, in other embodiments, such validation stamps may alternatively include just cartridge characteristic information 42. In one embodiments, output sample 22 may include each of stamps 70A-70D. In other embodiments, output sample 22 may include less than all of the described stamps.

Figure 2:
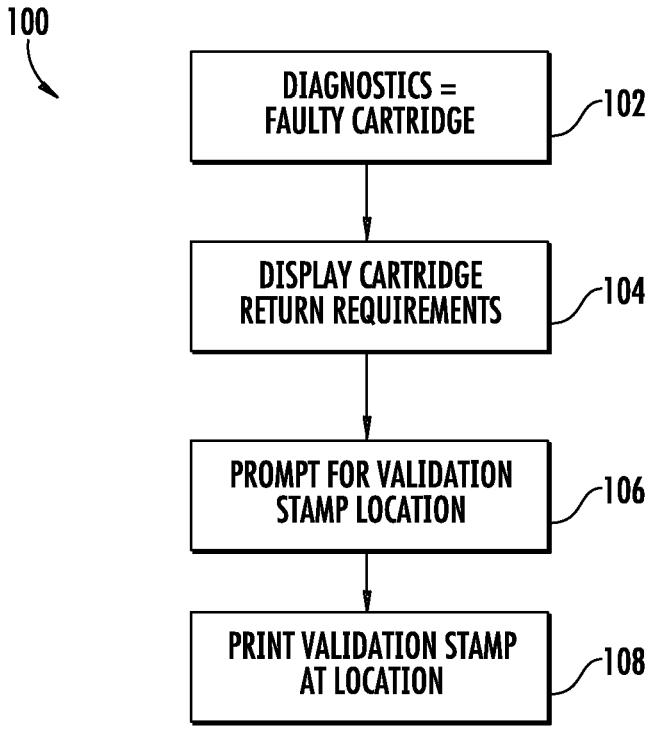
FIG. 2 is a flow diagram of a method for printing and validation stamp on the output sample of FIG. 1 according to an example environment.

As noted above, validation stamps 70 may be provided at various locations on medium 62. FIG. 2 illustrates a method 100 by which one or more of validation stamps 70 may be selected for printing on medium 62 of output sample 22. In step 102, a person has selected a diagnostic mode of printer 28. Controller 56 generates control signals running various diagnostic procedures in the diagnostic mode. The diagnostic mode indicates that errors appearing on printed output are at least partially caused by a malfunctioning or faulty print cartridge 26.

In step 104, controller 56 generates control signals causing display 55 to display or present requirements for returning cartridge 26. Such requirements may be stored in memory 52 or may alternatively be stored in memory 32 associated with cartridge 26. The requirements for returning cartridge 26 that are displayed by display 55 indicate that a defective sample or output sample 22 be printed using the defective cartridge 26. The displayed requirements for returning cartridge 26 further indicate that the output sample must include a validation stamp, such as one of stamps 70.

In step 106, controller 56 further generates control signals causing display 55 to provide or display a prompt requesting that a location for the validation stamp 70 be selected. In one embodiment, the validation stamp 70 may printed at a variety of different locations such as shown in FIG. 1. The user may also be given the option of deciding whether validation stamp is to overlie or block underlying printed portions 66. In some embodiments, step 106 may be omitted where the option of selecting a location for validation stamp 70 is not provided.

In step 108, controller 56, following instructions came in memory 52 or in memory 32, generates control signals directing print device 46 to print output sample 22. Due to the defective print cartridge 26, output sample 22 includes defective portions 64. One example of a defect 64 is a fade effect, wherein portions of printed portions 66 fadeout or are not printed. At selected portions of medium 62, controller 56 also generates control signals directing print device 46 to print the validation stamp 70 including at least cartridge characteristic information. As noted above, in one embodiment, the validation stamp 70 may additionally include printer characteristic information. In addition, one or both of the cartridge characteristic information 42 and the printer characteristic information 58 may be encrypted or otherwise rendered indiscernible, unviewable or unreadable to a naked eye. For example, the cartridge characteristic information or the printer characteristic information may use a key to decrypt the printed information or may require use of a selected light (such as ultraviolet light), magnification alike to read or discern the printed cartridge character information 42 or the printed printer characteristic information 58. As will be described hereafter, the printed validation stamp 70, including the printed cartridge character information 42, alone, or additionally including the printed printer characteristic information 58, is used to verify that the print cartridge 26 being returned is actually the print cartridge used to print the output sample 22 including defect 64. Those validation stamps 70 including printer characteristic information 58 may also be used to verify that the output sample 22 was printed not only with the print cartridge 26 being returned but that the print cartridge 26 and being returned printed output sample 22 using a correct printer 28 adapted to use print cartridge 26.

Figure 3:
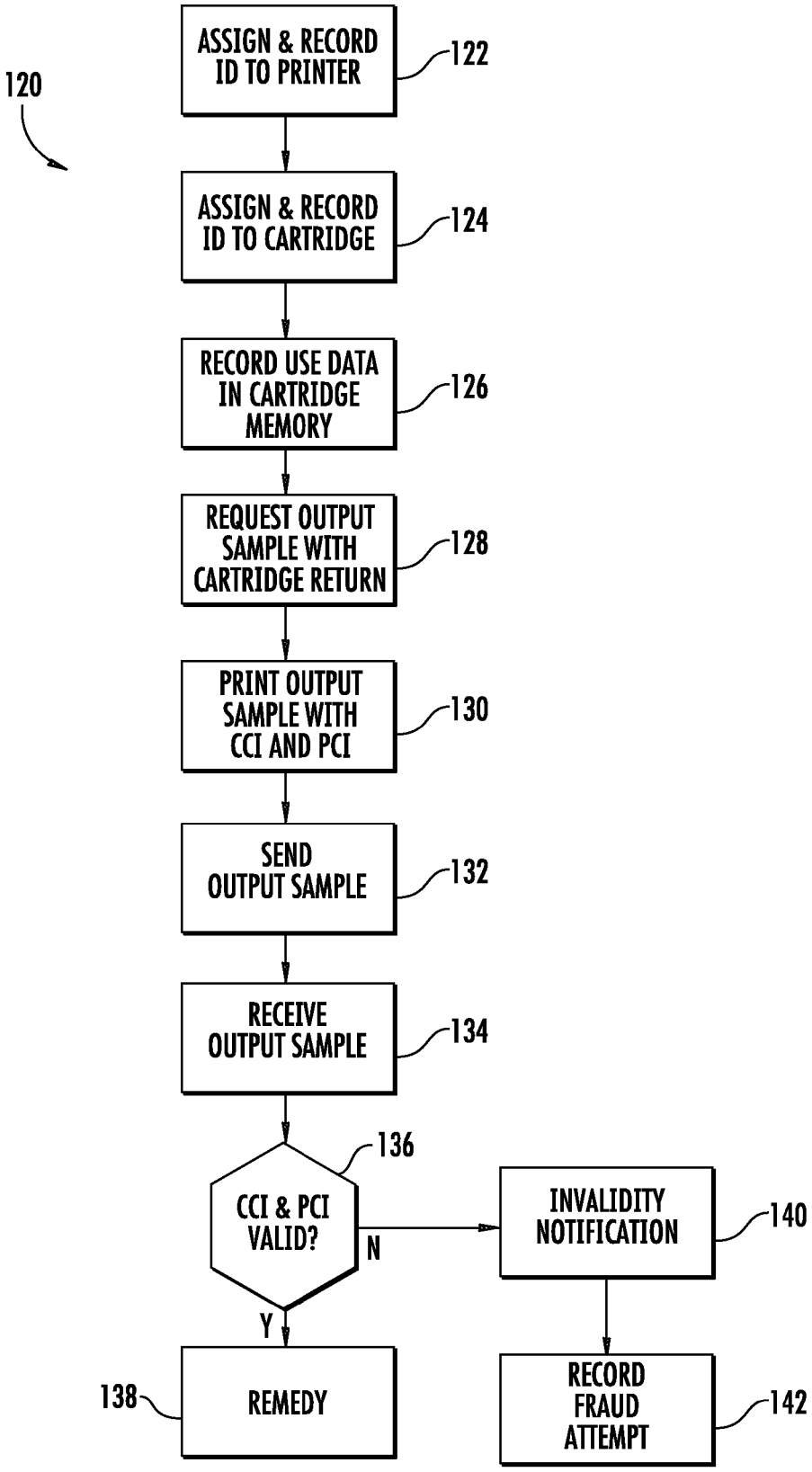
FIG. 3 is a flow diagram of a print cartridge return verification method according to an example embodiment.

FIG. 3 illustrates an example print cartridge return verification method 120. As indicated by step 122, one or more identifications or IDs are assigned to printer 28. Such identifications are recorded in memory 52 of printer 28. Examples of printer IDs include, but are not limited to, serial numbers, lot numbers, digital signatures and the like. Such identifications may uniquely identify an individual printer or may uniquely identify a family or group of particular printers. The assignment of the identifications may be made at the time of manufacture or assembly of printer 28. One or more of the printer identifications may not be available to a retailer or end-user of printer 28.

As indicated by step 124, one or more identifications or IDs are assigned to cartridge 26. Such identifications are recorded in memory 32 of cartridge 26. Examples of cartridge IDs include, but are not limited to, serial numbers, lot numbers, digital signatures and the like. Such identifications may uniquely identify an individual cartridge or may uniquely identify a family or group of particular cartridges. The assignment of the identifications may be made at the time of manufacture or assembly of cartridge 26. One or more of the cartridge identifications may not be available or viewable to a retailer or end-user of printer 28.

As indicated by step 126, during use of cartridge 26, controller 36 or controller 56 automatically records use data in memory 32 of cartridge 26. The use data they recorded as print materials being withdrawn from cartridge 26 or at any time while cartridge 26 is connected to printer 28. Examples of use data include, but are not limited to, the number of pages printed with cartridge 26, the percent or amount of printing material remaining in cartridge 26, the percent or amount of printing material or marking material discharged from cartridge 26, the percent life remaining of cartridge 26 and the like. Each time cartridge 26 is used for printing, this data is updated. In other embodiments, the use data may alternatively or additionally be stored in memory 52, wherein the use data is specifically assigned or associated with identification information for cartridge 26 in memory 52.

As indicated by step 128, the party attempting to return cartridge 26 is requested to provide an output sample, such as output sample 22, with the return of cartridge 26. This request may be made by the cartridge manufacturer, wholesaler or retailer in response to an inquiry from a party wishing to return cartridge 26. This request may alternatively be displayed or communicated to the party wishing to return cartridge 26 by a display associated with printer 28 or an external computing device connected to printer 28 in a wired or wireless fashion. The request may be displayed to the party in response to control signals generated by controller 36 in cartridge 26 or controller 56 in printer 28, following instructions contained in memory 32 or memory 52, respectively. The request may also be made in printed materials provided with cartridge 26 or with printer 28.

In one embodiment, such request specifically informs a party wishing to return cartridge 26 that the sample output must include a validation stamp. In another embodiment, the output sample request may instruct the party wishing to return cartridge 26 to follow a particular procedure or input a selected series of inputs to printer 28 correcting printer 28 to print output sample 22 with a validation stamp 70. For example, the party may be present with an option of "print output sample for return of cartridge", wherein the output sample 22 automatically includes validation stamp 70.

As indicated by step 130, printer 28 print output sample 22 including a validation stamp 70 including at least cartridge characteristic information 42. In the example illustrated, the validation stamp 70 printer includes both cartridge characteristic information 42 and printer characteristic information 58. In one embodiment, this information is encrypted or otherwise indiscernible to a naked eye. As noted above, the output sample 22 edition includes the defect 64 presumably produced by cartridge 26.

As indicated by step 132, the party wishing to return cartridge 26 (or wishing to receive a remedy for the allegedly defective cartridge 26) sends at least output sample 22 to a designated cartridge return center, address or party, designated customer service agent or site, cartridge manufacture, the cartridge wholesaler or other parties in charge of validating or verifying the authenticity of the cartridge remedy request (hereinafter the "verifying party"). In one embodiment, the output sample 22 may be sent electronically to the return party, return center or return address. In another embodiment, the output sample 22 may be sent via mail. Because the output sample identifies the cartridge 26 used to print the output sample 22, the sending of cartridge 26, itself, may be skipped, saving cost. As noted above, in embodiments where the printer characteristic information 58 is also included as part of validation stamp 70 and includes information regarding whether printer 28, itself, is properly functioning, the cartridge manufacture or wholesaler may determine from the output sample 22, itself, whether the cartridge 26 that printed the received output sample 22 is indeed defective without inspecting cartridge 26. In other embodiments, output sample 22 may be returned with the allegedly defective cartridge 26.

As indicated by step 134, the output sample 22 is received from the party wishing to receive a remedy for the allegedly defective cartridge 26. Receipt may be made by a verifying party. As indicated by step 136, the verifying party inspects and analyzes at least the cartridge characteristic information 42 to determine whether the attempted return of cartridge 26 or the request for a remedy for the allegedly defective nature of cartridge 26 is valid. In some examples, the verifying party additionally inspects the printer characteristic information 58 printed on the validation stamp 70. In particular, the verifying party may inspect the cartridge characteristic information 42 on the validation stamp 70 to determine whether the received output sample 22 including defect 64 was actually printed by a print cartridge manufactured or sold by the verifying party or the manufacturer or wholesaler represented by the verifying party. In addition, the verifying party may also inspect the cartridge characteristic information 42 to determine whether the print cartridge 26 alleged as being defective has been improperly refurbished based upon use data of cartridge characteristic information 42 printed as part of validation stamp 70. For example, the use data may indicate that the cartridge 26 alleged as being defective and for which a remedy is requested had been fully spent or near fully spent. In such a case, the verifying party may conclude that the party requesting a remedy is not entitled to a remedy or that any remedy should be prorated given the nearly complete use of cartridge 26. In circumstances where the printer cartridge characteristic information 58 is also printed as part of validation stamp 70, the verifying party may also check whether cartridge 26 was used in conjunction with an appropriate printer 28 when printing output sample 22. For example, if it is determined that the reason effect 64 resulted was that cartridge 26 were utilized in conjunction with an improper printer 28, the alleged defective nature of cartridge 28 may be deemed untrue and a remedy may be denied.

As indicated by step 138, if the verifying party determines that (1) the defect 64 printed on output sample 22 is a result of a defective print cartridge 26 (and not printer 28 or the printing of output sample 22 using cartridge 26 in a printer not configured to work with cartridge 26), (2) that the cartridge 26 used to print the output sample is the same cartridge that is alleged as being defective, and (3) that the useful life of the print cartridge 26 alleged as being defective is not already been substantially exhausted (the cartridge 26 was not slightly refurbished simply for purposes of the return or requested remedy), the verifying party authorizes the requested remedy. As noted above, the remedy may comprise ever placement print cartridge 26, an account credit for future purchases, a monetary payment or a return of a newer scheduling new print cartridge 26. The remedy may also be prorated in circumstances where a portion of the useful life of cartridge 26 or its printing material has been consumed.

Alternatively, if the verifying party determines that the allegation that print cartridge 26 is defective is fraudulent or untrue, the verifying party may deny a remedy. For example, if the verifying party determines that (1) the defect 64 printed on output sample 22 was caused by the print cartridge 26 alleged is being defective (because of the defect 64 was printer 28 or the improper use of cartridge 26 with a printer 28 not configured for use with cartridge 26), (2) that the cartridge 26 used to print the output sample is the same cartridge that is alleged as being defective or (3) that the useful life of the print cartridge 26 alleged as being defective has already been substantially exhausted (the cartridge 26 was slightly refurbished simply for purposes of the return or requested remedy), the verifying party may deny the remedy.

As indicated by step 140, should the verifying party deny a remedy, the verifying party or another party at the request of the verifying party may notify the party requesting a remedy of the denial. Such communication may be made electronically, by phone or other means of communication. In other embodiments where fraud is determined, set 140 may be omitted.

As indicated by step 142, in those instances where the remedy is denied and where it is determined that the attempt to obtain a remedy was improperly made, the fraud attempt may be recorded or stored. For example, the name of the remedy requesting party, the date that the remedy request was made, the address of the remedy requesting party and the type of fraudulent return may recorded in a database. This database may be consulted when the same remedy requesting party attempts future returns or exchanges of other cartridges or products. As a result, the likelihood of the same remedy requesting party obtaining a fraudulent remedy in the future may be reduced.

Figure 4:
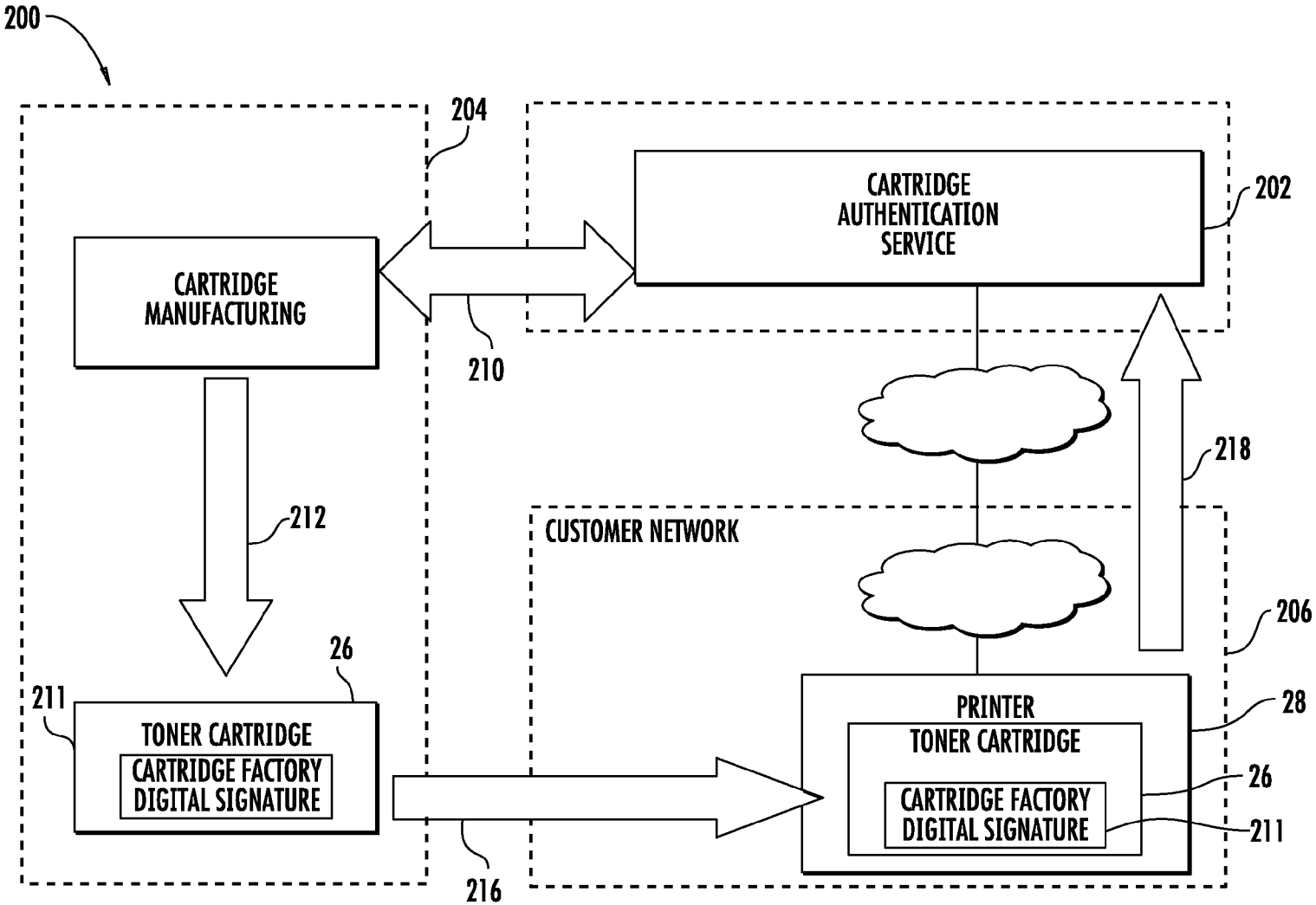
FIG. 4 is a schematic illustration of a print cartridge return system according to an example embodiment.

FIG. 4 schematically illustrates one example of a print cartridge return verification system 200 and print cartridge verification method. System 200 includes a cartridge authentication service 202, a cartridge manufacturer 204 and a customer network 206. Cartridge authentication service 202 comprises party assigned the task of verifying that a request for remedy for an allegedly defective print cartridge is valid. Cartridge manufacturer 204 is a party that manufactures print cartridges. The cartridge manufacturer may be part of the same company or entity as the cartridge authentication service 202 or may be a distinct entity or organization, such as a party contracted to manufacture cartridges. The customer network 206 comprises one or more entities or parties which are involved with ultimate and consumer or end customer interactions. The customer network may include retail sale entities, distributors or customer service centers.

As represented by interaction arrow 210, the cartridge authentication service 202 and the cartridge manufacturer agree on a secret cartridge identifier 211 to be assigned to one or more of the print cartridges, such as cartridge 26, manufactured by cartridge manufacturer 204. One example of such a cartridge identifier 211 is a digital signature assigned to each cartridge manufacturer by cartridge manufacturer 204. As represented by arrow 212, the agreed upon cartridge identifier 211 is incorporated into toner cartridge 26. In one embodiment, the agreed upon cartridge identifier 211 is written to memory 32 (shown in FIG. 1) of cartridge 26.

As represented by interaction arrow 216, in use, cartridge 26 is inserted into a printer, such as printer 28. When an output sample 22 (shown in FIG. 1) is to be printed by printer 28, the cartridge identifier 211 (the digital signature and the information that was signed) is read from cartridge 26. As represented by interaction arrow 218, the output sample 22 (shown in FIG. 1) is sent to cartridge authentication service 202. Cartridge verification service 20 to verify the validity of the cartridge return or requests for remedy using the original secret cartridge identifier agreed upon in step 210.

Figure 5:
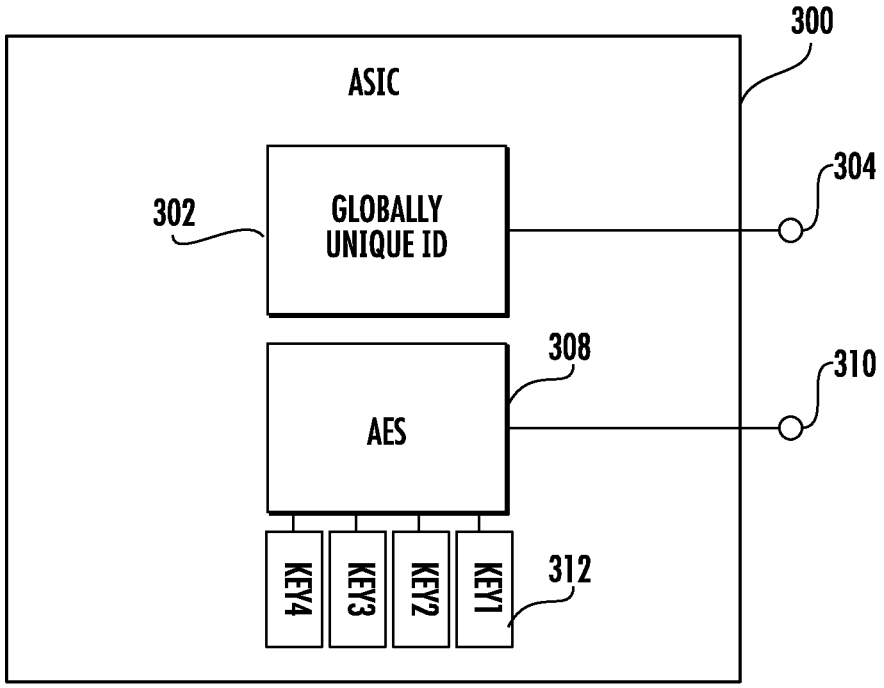
FIG. 5 is a schematic illustration of an ASIC storing cartridge characteristic information according to an example embodiment.

FIG. 5 schematically illustrates one example application specific integrated circuit (ASIC) 300 for storing cartridge characteristic information 42 which may be provided as part of cartridge 26. An example illustrated, ASIC 300 includes an assigned cartridge identifier 302 connected to an external interface 304. ASIC 300 additionally includes an encryption logic block (AES) 308 connected to an external interface 310. The encryption logic block 308 is configured to access one or more keys to 312 which are extensible only to the encryption block 308. When a validation stamp, such as validation stamp 70, is to be printed on output sample 22 (shown in FIG. 1), printer 28 accesses ASIC 300 using external interfaces 304 and 310. The cartridge verification 302 automatically fills a part of the encryption block. The rest of the encryption block is filled with data, such as other cartridge characteristic information 42, to be signed. The same or similar ASIC maybe provided as part of memory 52 of printer 28 for the printer characteristic information.

Figure 6:
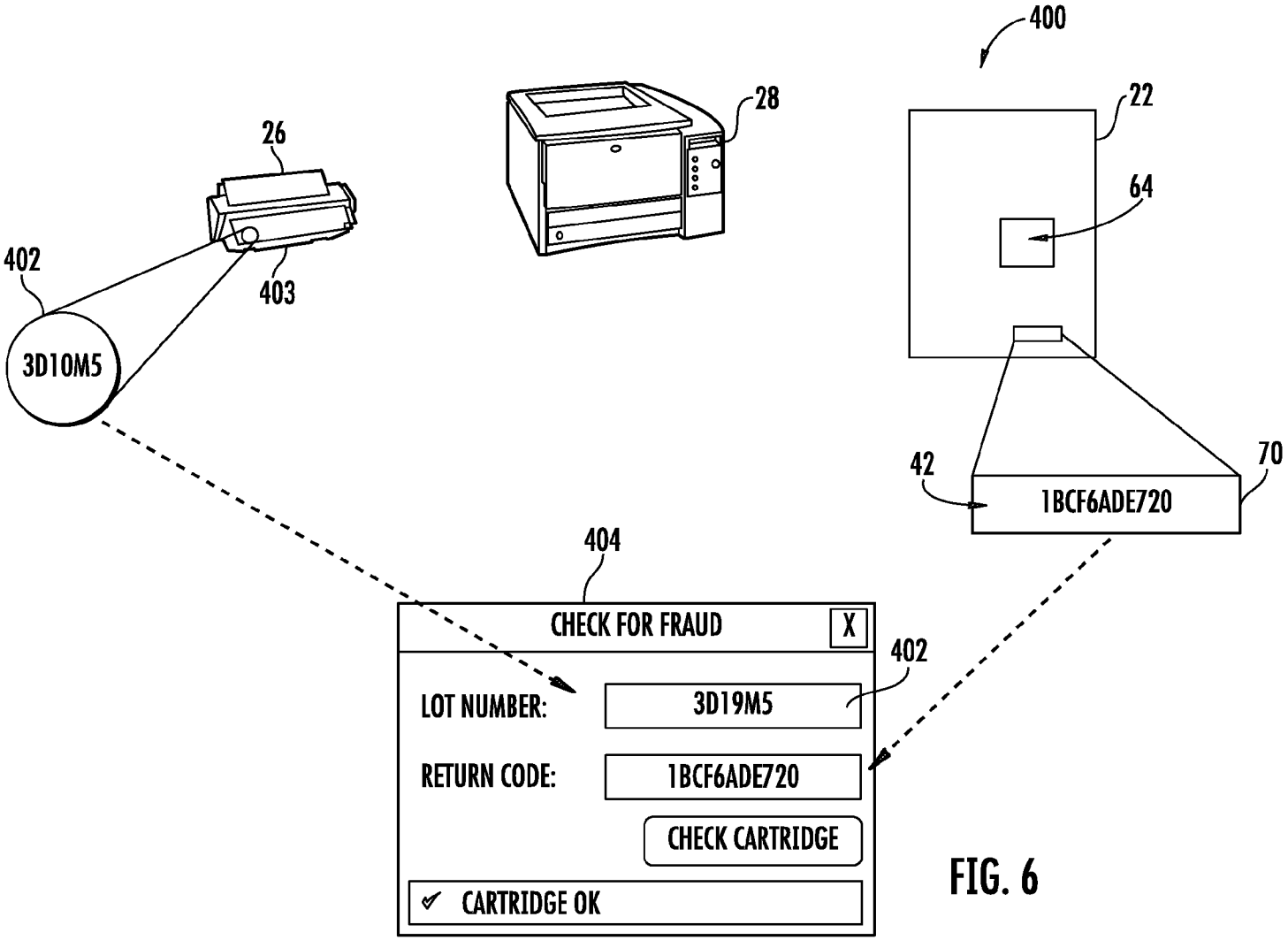
FIG. 6 is a schematic illustration of a print cartridge return verification method according to an example embodiment.

FIG. 6 schematically illustrates an example method 400 for verifying the validity of a returned cartridge. As shown by FIG. 6, an example print cartridge 26 is coupled to a example printer 28 and is used to print an output sample 22 including a defect 64 and further including an example validation stamp 70. An example illustrated, the validation stamp 70 includes cartridge characteristic information 42 comprising a return code identifying cartridge 26. For example, the return code may comprise information for pertaining to what date cartridge 26 was manufactured or what date the return code constituting cartridge characteristic information 42 was written to the memory associated with cartridge 26. In one embodiment, cartridge characteristic information 42 is written on an electronic label (sometimes referred to as an E.-label). The return phone is read from the label by printer 28 when validation stamp 70*s* printed on output sample 22. In one embodiment, the return code may be encoded.

As further shown by FIG. 6, the cartridge 26 itself includes an imprinted, molded, stamped or other marking including cartridge characteristic information. In the example illustrated, the cartridge characteristic information comprises a lot number 402 formed on the housing 403 of cartridge 26.

As schematically represented by box 404, when determining or verifying the validity of a cartridge return, a verifying party will compare lot number 402 found on the exterior of housing 403 of cartridge 26 to the return code printed on the output sample 22. If the lot number 402 corresponds to the return code, the cartridge return is deemed valid and a remedy is provided. For example, lot number 402 may be assigned to print cartridges manufactured on a certain day. The return code may indicate the date that the electronic label was written. If the date associated with the lot number 402 and the date associated with the return code 42 are sufficiently close, the lot number and the return code are deemed to be matching.

In some embodiments, an additional verification step may be performed. For example, in some embodiments, cartridge 26 may additionally be provided with a serial number that is digitally signed in the factory when cartridge 26 is manufactured. The verifying party may additionally evaluate the digital signature printed as part of the validation stamp 70 to ensure that the return of cartridge 26 is valid.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A system comprising:

a print cartridge having a body and a memory carried by the body, the memory including print cartridge characteristic information to uniquely identify the print cartridge as a particular print cartridge;

a printer;

a print device provided by the print cartridge or the printer; and a controller provided by the print cartridge or the printer, the controller configured to read the print cartridge characteristic information from the memory and then to direct the print device to print an output sample using print material from the print cartridge, the output sample including a validation stamp comprising the print cartridge characteristic information read from the memory of the print cartridge, wherein the validation stamp is to validate that the output sample was printed with the particular print cartridge.

2. The system of claim 1, wherein the print cartridge characteristic information printed as part of the validation stamp is encrypted.

3. The system of claim 2, wherein the output sample further includes printer characteristic information of the printer.

4. The system of claim 3, wherein the printer characteristic information printed as part of the validation stamp is encrypted.

5. The system of claim 4, wherein the printer characteristic information is selected from a group of printer characteristic information consisting of: printer serial number and digital signature generated by the printer.

6. The system of claim 2, wherein the print cartridge characteristic information is selected from a group of information consisting of: cartridge model information, cartridge life, cartridge manufacturer date, cartridge serial number, digital signature generated by cartridge manufacturer, pages printed with cartridge, present life remaining of cartridge and authentication state of cartridge.

7. The system of claim 1 comprising a display, wherein the controller is configured to generate control signals directing the display to provide a user with a first selection prompt for including the cartridge characteristic information with the output sample or excluding the cartridge characteristic information.

8. The system of claim 7, wherein the controller is configured to generate control signals directing the display to provide a user with a second selection prompt for locating the validation stamp in one of a plurality of available locations on the output sample.

9. The system of claim 1, wherein the print cartridge characteristic information is selected from a group of information consisting of: cartridge model information, cartridge life, cartridge manufacturer date, cartridge serial number, digital signature generated by cartridge manufacturer, pages printed with cartridge, present life remaining of cartridge and authentication state of cartridge.

10. The system of claim 1, wherein the output sample further includes printer characteristic information of the printer.

11. The system of claim 10, wherein the printer characteristic information printed as part of the validation stamp is encrypted.

12. The system of claim 10, wherein the print cartridge characteristic information is selected from a group of information consisting of: cartridge model information, cartridge life, cartridge manufacturer date, cartridge serial number, digital signature generated by cartridge manufacturer, pages printed with cartridge, present life remaining of cartridge and authentication state of cartridge.

13. The system of claim 1, further comprising an authentication service to validate that the output sample was printed with the particular print cartridge by using the print cartridge characteristic information in the validation stamp.

14. An apparatus comprising:

a printer configured to print using print material from a print cartridge having a memory with print cartridge characteristic information, the printer including a controller configured to read the print cartridge characteristic information from the memory and then to direct the printer to print an output sample using print material from the print cartridge, the output sample including a validation stamp including the print cartridge characteristic information read from the memory of the cartridge.

15. A method comprising:

receiving an output sample including a print cartridge validation stamp from a party returning a print cartridge, the print cartridge validation stamp comprising cartridge characteristic information of a print cartridge used to print the output sample;

reading cartridge characteristic information stored in a memory of the print cartridge being returned; and evaluating the print cartridge validation stamp to determine if the print cartridge being returned is the print cartridge used to print the output sample by comparing the print cartridge characteristic information of the print cartridge validation stamp with the print cartridge characteristic information read from the memory.

16. The method of claim 15, wherein at least a portion of the print cartridge validation stamp is encrypted or invisible to a naked eye.

17. The method of claim 15, wherein reading cartridge characteristic information comprises accessing the memory of the print cartridge being returned using a processor, the memory being processor readable memory.

* * * * *